United States Patent [19]

Murakami et al.

[11] Patent Number: 4,578,977

[45] Date of Patent: Apr. 1, 1986

[54] APPARATUS FOR PERFORMING ROLL BENDING ON SHAPE METAL

[75] Inventors: Hiroya Murakami; Mitsuhiro Takasaki, both of Yokohama, Japan

[73] Assignee: Hitachi, Ltd., Tokyo, Japan

[21] Appl. No.: 549,810

[22] Filed: Nov. 8, 1983

[51] Int. Cl.[4] ..... B21B 1/08; B21B 13/10

[52] U.S. Cl. ..... 72/135; 72/224

[58] Field of Search ..... 72/135, 137, 224, 225, 72/226

[56] References Cited

U.S. PATENT DOCUMENTS

| | | | |
|---|---|---|---|
| 1,602,788 | 10/1926 | Thomes | 72/225 X |
| 1,920,154 | 7/1933 | Carlson | 72/137 X |
| 2,374,802 | 5/1945 | Breuer | 72/225 |
| 3,472,054 | 10/1969 | Schmitt et al. | 72/225 |

FOREIGN PATENT DOCUMENTS

| | | | |
|---|---|---|---|
| 409983 | 5/1934 | United Kingdom | 72/135 |
| 534277 | 2/1977 | U.S.S.R. | 72/135 |
| 643983 | 1/1979 | U.S.S.R. | 72/135 |

*Primary Examiner*—E. Michael Combs

*Attorney, Agent, or Firm*—Antonelli, Terry & Wands

[57] ABSTRACT

An apparatus for performing roll bending on shape metal including a first rolling roll, a second rolling roll having an outer circumferential surface juxtaposed against an outer circumferential surface of the first rolling roll, and third and fourth rolling rolls having outer circumferential surfaces opposed against end faces of the first and second rolling rolls respectively. Two to four rolls selected from the group of the four rolling rolls are used for performing roll bending on shape metal in such a manner that the shape metal has, after being subjected to the roll bending, a thickness which successively decreases in going toward its outer portion from its central portion.

1 Claim, 17 Drawing Figures

APPARATUS FOR PERFORMING ROLL BENDING ON SHAPE METAL

BACKGROUND OF THE INVENTION

This invention relates to apparatus for performing roll bending on shape metal, such as an angle bar, channel bar, etc., and more particularly it is concerned with an apparatus of the type described which enables shape metal of various shapes and dimensions to be bent by rolling.

Apparatus for performing bending of shape metal include tension bending apparatus, angle benders and roll bending apparatus, for example. In tension bending apparatus, shape metal of a required length is gripped at opposite ends and wound on a forming die of the required profile while imparting a tension thereto, so as to thereby bend the shape metal.

When bending operations are performed on shape metal by using this type of apparatus, it is necessary that at ension of a higher magnitude be imparted to the shape metal as the radius of curvature of the bend of the shape metal increases. Application of a tension of high magnitude produces a high degree of elongation in the shape metal, and since an outer edge portion of the shape metal undergoes elongation due to the bending working performed thereon, the outer edge portion can be ruptured or fall toward the form die, or the dimension of the shape metal in the radial direction can undergo great changes. When these troubles occur, it is impossible to bend the shape metal into a desired shape.

An angle bender comprises a rotatable base supporting a winding roll and a clamp jig, a working roll located in face-to-face relation to the base and the winding roll while being spaced apart therefrom by a distance corresponding to the thickness of the shape metal to be handled, and a guide roller for guiding and regulating the travel of the shape metal. In the angle bender of this construction, shape metal is inserted between the winding roll and the working roll along the guide roller and secured at one end to the base by means of the jig. As the base is rotated when the parts are in the aforesaid condition, the shape metal is wound on the winding roll because its travel is guided and regulated by the guide roller and the working roll, so that the shape metal can be bent as desired.

When bending is performed as described herein above, forces exerted on inner edge and outer edge portions of the shape metal might vary from each other when it is and buckling can occur in the inner edge portion of the shape metal. Thus, this bending apparatus suffers from the disadvantage of being unable to handle shape metal of thin thickness.

A roll bending apparatus is used for bending shape metal by rolling in such a manner that the thickness is successively reduced in going from the inner edge toward the outer edge when bending of the shape metal is accomplished. Such apparatus is disclosed in U.S. Pat. No. 3,388,449, for example.

This type of roll bending apparatus is capable of obtaining a bend of a relatively small diameter. However, it is disadvantageous in that limitations are placed on the shape and dimensions of the shape metal that can be handled, so that the usefulness of the apparatus is restricted.

SUMMARY OF THE INVENTION

It is an object of this invention to provide an apparatus for performing roll bending on shape metal which is capable of performing roll bending on shape metal of different shapes and dimensions.

The outstanding characteristic of the invention which enables the aforesaid object to be accomplished is that the apparatus comprises a first rolling roll, a second rolling roll having an outer circumferential surface located in juxtaposed relation to an outer circumferential surface of the first rolling roll, and a third rolling roll and a fourth rolling roll each having an outer circumferential surface located in juxtaposed relation to one of opposite end faces of the first and second rolling rolls, wherein the second rolling roll is arranged in such a manner that it can move toward and away from the first rolling roll and the third and fourth rolling rolls are arranged in such a manner that they can move toward and away from the first rolling roll and have an angle formed by them and the first rolling roll adjusted as desired, so that two to four rolling rolls selected from the first to fourth rolling rolls are selectively rendered operative to perform roll bending on shape metal.

DESCRIPTION OF THE PREFERRED EMBODIMENT

Figure 1:
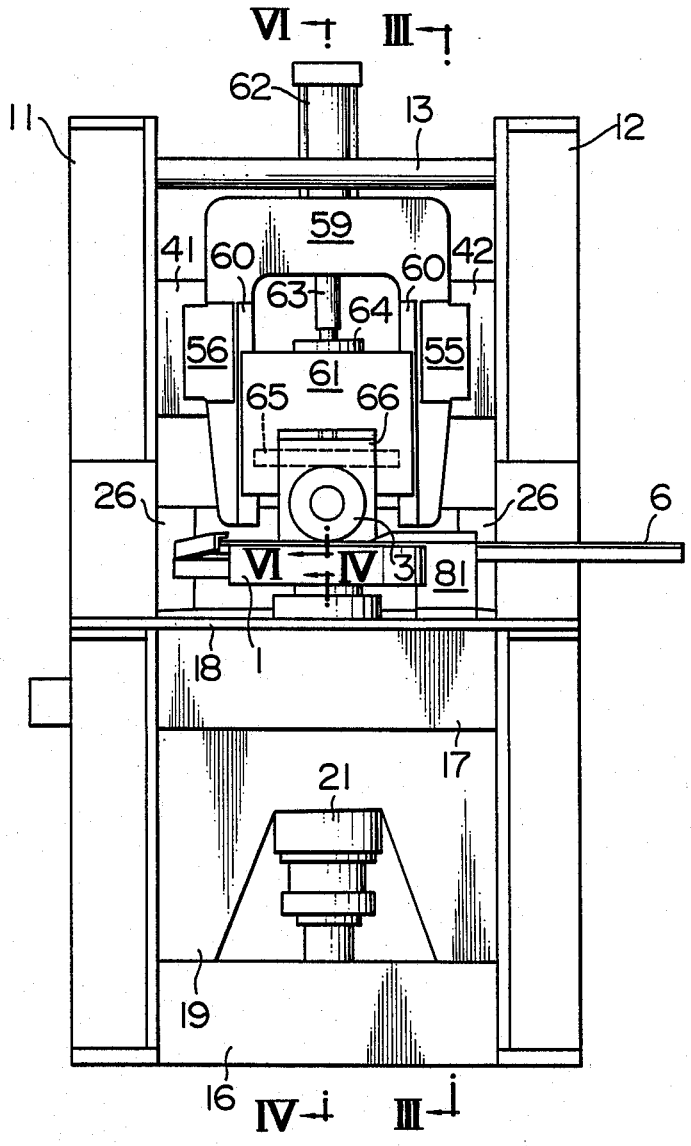
FIG. 1 is a front view of the apparatus for performing roll bending on shape metal showing one, preferred embodiment of the invention.
Figure 2:
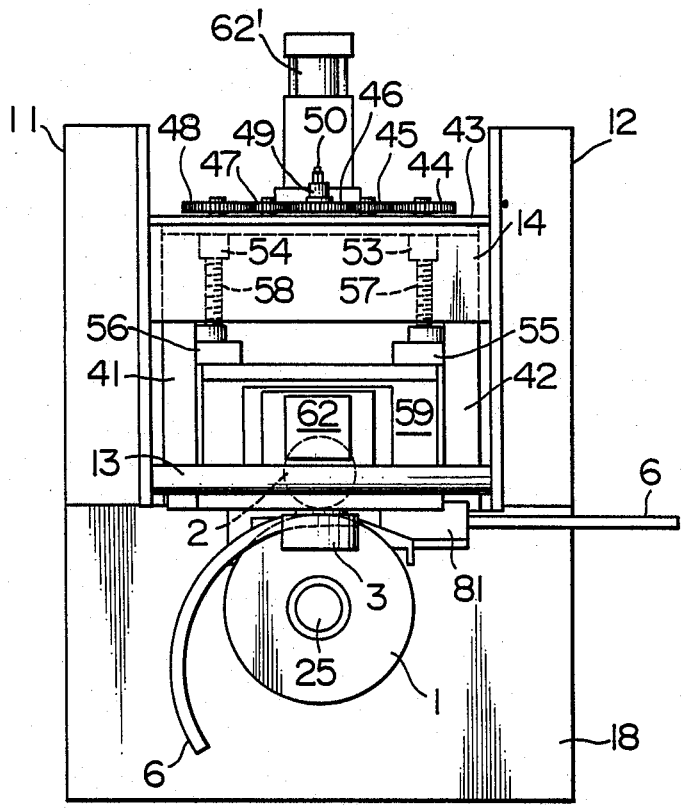
FIG. 2 is a plan view of the apparatus shown in FIG. 1.

Referring now to the drawings, the construction of the apparatus for performing roll bending on shape metal according to the invention FIGS. 1–6 when it is seen that a pair of frames 11 and 12 are connected together by a multiplicity of beams 13, 14, 15, 16 and 17 to provide a unitary structure which supports a table 18. Four rolling rolls 1, 2, 3 and 4 constituting the essential parts of the invention are supported by this structure as follows.

Roll 1 (see FIGS. 1–4)

A frame 19 interposed between the two frames 11 and 12 has secured thereto a support member 20 which supports a hydraulic motor (hereinafter motor for short) 21 having an output shaft which is connected to a lower end of a shaft 25 rotatably supported by the frame 19 through bearings 22, 23 and 24. The roll 1 is supported on an upper end of the shaft 25.

In the aforesaid construction, actuation of the motor 21 causes the shaft 25 to rotate, to thereby cause the roll 1 to rotate.

Figure 3:
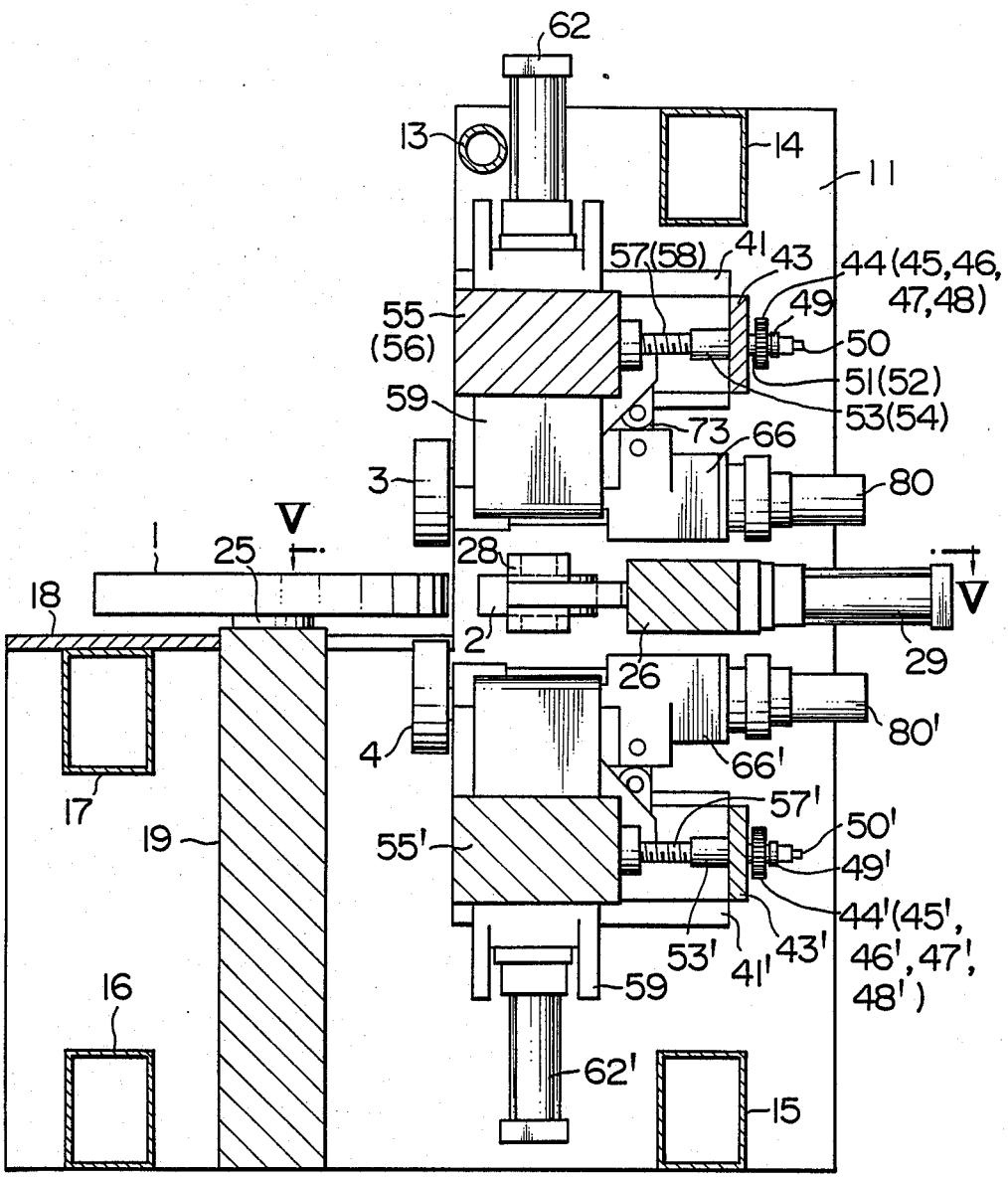
FIG. 3 is a sectional view taken along the line III—III in FIG. 1.
Figure 5:
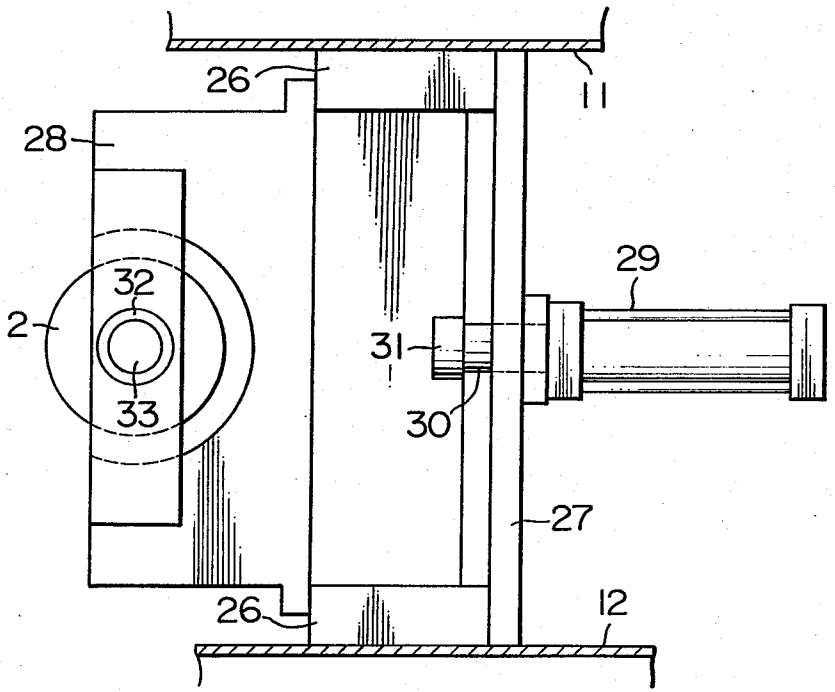
FIG. 5 is a sectional view taken along the line V—V in FIG. 3.
Figure 4:
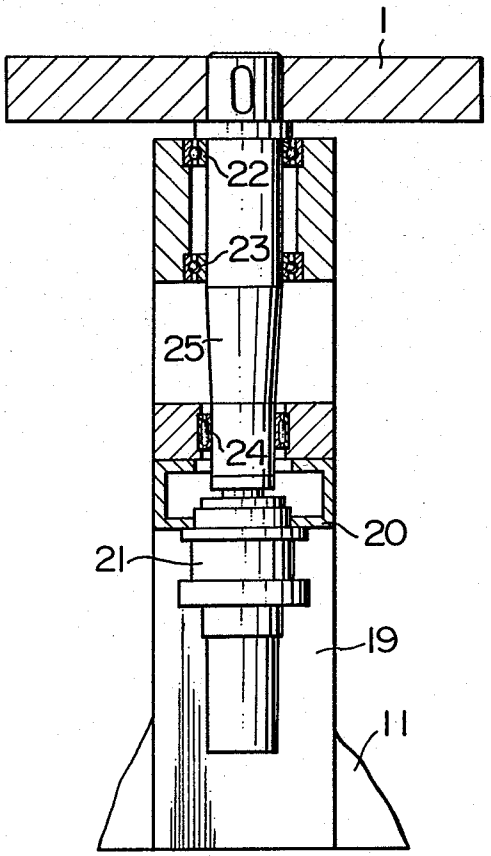
FIG. 4 is a sectional view taken along the line IV—IV in FIG. 1.

Roll 2 (see FIGS. 1, 3 and 5)

A pair of guides 26 are located along opposed surfaces of the frames 11 and 12 respectively and supported thereby, and a support member 27 extends between the opposed surfaces of the frames 11 and 12 and is supported thereby. A slider 28 is slidably fitted between the guides 26, and the support member 27 supports a hydraulic cylinder (hereinafter cylinder for short) 29 having a rod 30 inserted therein which is connected to the slider 28 through a load cell 31. The slider 28 supports at one end thereof a shaft 33 through a bearing 32 for rotation. The roll 2 is supported by the shaft 33.

The roll 2 is arranged such that its outer circumferential surface is located in juxtaposed relation to an outer circumferential surface of the roll 1 and the roll 2 can be moved toward and away from the roll 1 as the cylinder 29 is actuated.

Roll 3 (see FIGS. 1, 2, 3 and 6)

A pair of guides 41 and 42 are located along the opposed surfaces of the pair of frames 11 and 12 and supported thereby, and a support member 43 is secured to one end of each of the guides 41 and 42 and supports for rotation five gears 44, 45, 46, 47 and 48 in meshing engagement with one another. Gear 46 is supported by a shaft 49 which is formed at one end thereof with a head 50 which can be engaged as with a spanner when it is desired to turn the shaft 49. Gears 44 and 48 are supported by shafts 57 and 58 having nuts 53 and 54, respectively, secured to one end thereof. Thus, when shaft 49 is turned, nuts 53 and 54 simultaneously rotate in the same direction at the same speed. The guides 41 and 42 support sliders 55 and 56, respectively, for sliding movement. The sliders 55 and 56 have secured thereto threaded shafts 57 and 58 which are in threadable engagement with the nuts 53 and 54 respectively at one end thereof. Thus, when nuts 53 and 54 rotate, sliders 55 and 56 simultaneously move in the same direction and a same distance. A block 59 in the form of a letter U is secured between the sliders 55 and 56 in such a manner that an opening thereof faces downwardly and is formed with guide surfaces 60 having a block 61 slidably fitted therebetween. Block 59 supports a hydraulic cylinder (hereinafter cylinder for short) 62 having a rod 63 which is connected through a load cell 64 to block 61. Thus, actuation of the cylinder 62 causes block 61 to move along the guide surfaces 60. Block 61 supports a housing 66 for rotation through a shaft 65, the housing 66 being biased by a compression spring (hereinafter spring for short) 67 mounted between itself and block 61. Block 61 has fitted therein a bush 68 threadably engaging a threaded shaft 69 having two nuts 70 threadably engaging one end portion thereof and a joint 71 secured to the other end thereof. The joint 71 is connected to the housing 66 through a shaft 72, a link 73 and a shaft 74, to thereby regulate the rotation of the housing 66. Thus, by turning the nuts 70 to adjust the vertical position of the threaded shaft 69, it is possible to regulate the tilting of the housing 66. A shaft 79 is rotatably supported by the housing 66 through bearings 75, 76, 77 and 78 and connected at one end thereof to an output shaft of a hydraulic motor (hereinafter motor for short) 80 supported by the housing 66. The roll 3 is supported at other end of the shaft 79.

Thus, by turning the shaft 49, it is possible to adjust the gap L between the rolls 3 and 1. Actuation of cylinder 62 moves the roll 3 toward and away from the roll 1. By adjusting the vertical position of threaded shaft 69, it is possible to regulate the inclination of the outer circumferential surface of the roll 3 with respect to the end face of the roll 1. Actuation of motor 80 enables the roll 3 to rotate.

Roll 4 (see FIG. 3)

The roll 4 is supported by a support mechanism which is of the same construction as the support mechanism for the roll 3, except that the support mechanisms for the rolls 3 and 4 vary from each other in phase by 180 degrees. Thus, parts of the support mechanism for the roll 4 shall be designated by the reference characters designating corresponding parts of the support mechanism for the roll 3 by adding an apostrophe and their detailed description shall be omitted.

Working performed on shape metal by the roll bending apparatus of the aforesaid construction according to the invention will now be described by placing emphasis on the arrangement of the rolls.

Figure 7:
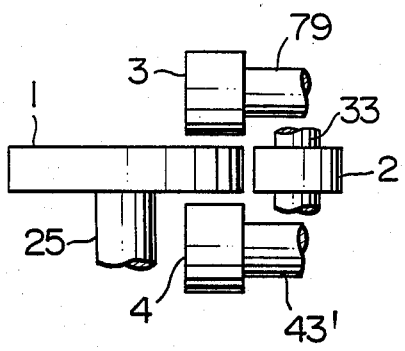
FIG. 7 is a side view of the four rolling rolls, showing their arrangement.

The four rolls 1, 2, 3 and 4 of the roll bending apparatus are generally arranged as shown in FIG. 7. Two to four rolls are selected from the rolls 1–4 in conformity with the shape of the shape metal to be worked on.

1. Operation of bending an angle bar in such a manner that a flange is located on the outside (referred to as outward bending).

Figure 8:
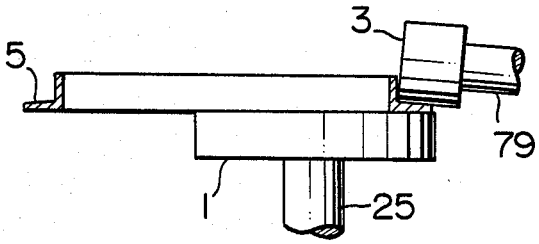
FIG. 8 is a view showing the arrangement of the rolling rolls for performing outward bending on an angle bar.

When outward bending is performed, bending is performed by the rollers 1 and 3 on an angle bar 5, as shown in FIG. 8. More specifically, the roll 3 is tilted with respect to the roll 1 in such a manner that the gap between them successively decreases in size in going toward the outer circumferential surface of the roll 1, and the angle bar 5 is fed to the rolls 1 and 3 in such a manner that one of two sides thereof is inserted in the gap and rolling is performed thereon so that its thickness will linearly decrease in going from its inner edge toward its outer edge.

Figure 6:
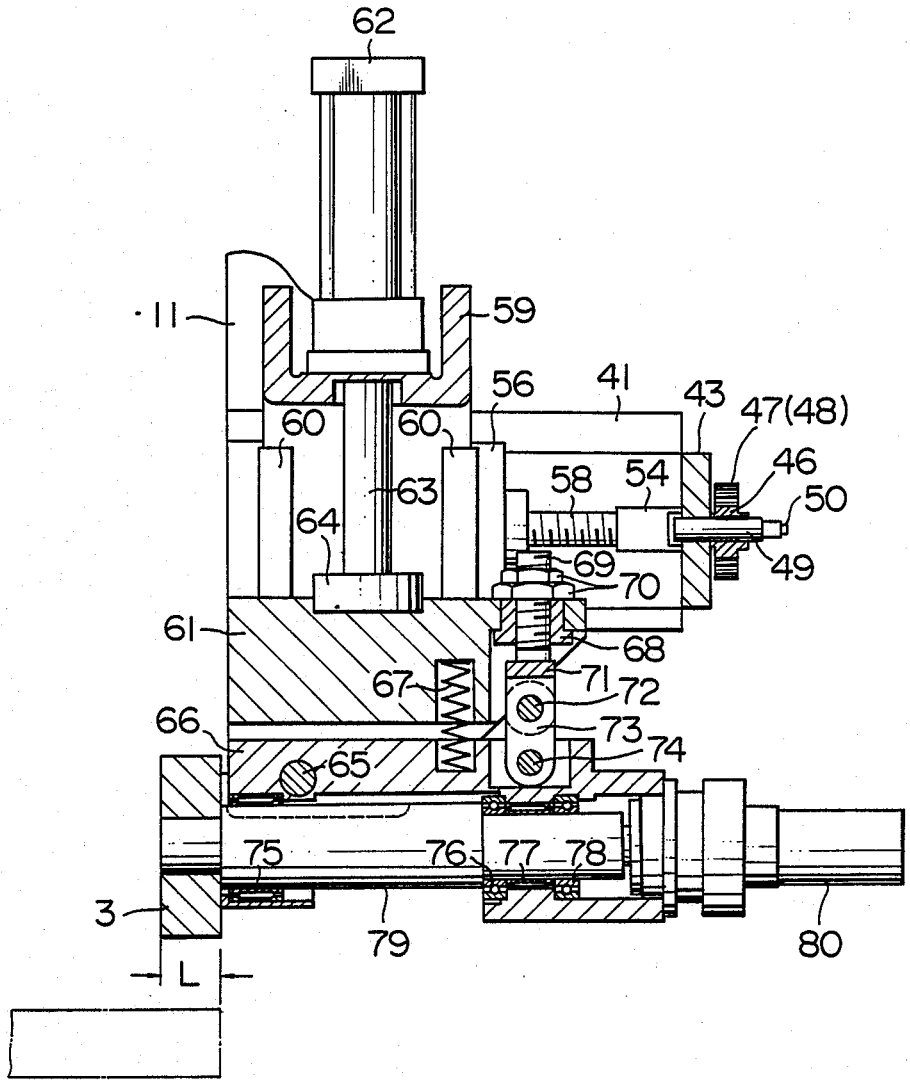
FIG. 6 is a sectional view taken along the line VI—VI in FIG. 1.

More specifically, the nuts 70 shown in FIG. 6 are turned to adjust the vertical position of the threaded shaft 69 to regulate the tilting of shaft 79 to thereby regulate the tilting of the roll 3 with respect to the roll 1. Then, shaft 49 is rotated by the head 50 to move the roll 3 in radial direction of the roll 1, to position the former with respect to the latter. Cylinder 62 is actuated to move the roll 3 toward the roll 1, and one end of the angle bar 5 guided by a guide 81 is inserted in the gap between the rolls 1 and 3. Thereafter, the motors 21 and 80 are actuated to rotate the rolls 1 and 3 respectively, to perform roll bending on the angle bar 5. At this time, a pressure applied to the roll 3 is sensed from an output of the load cell 64 and the pressure applied to cylinder 62 is adjusted accordingly, to perform uniform roll bending on the angle bar 5.

2. Operation of bending an angle bar in such a manner that a flange is located on the inside (referred to as inward bending).

Figure 9:
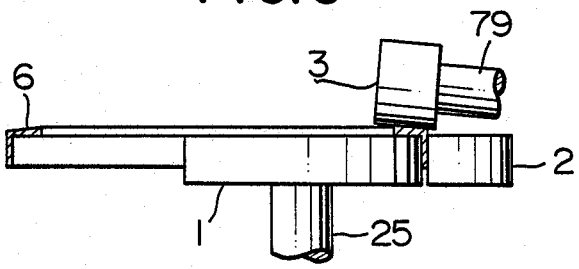
FIG. 9 is a view showing the arrangement of the rolling rolls for performing inward bending on an angle bar.

As shown in FIG. 9, the rolls 1–3 are used for performing roll bending on an angle bar 6. More specifically, the roll 3 is tilted with respect to the roll 1 in such a manner that the gap between them successively decreases in size in going toward the outer circumferential surface of the roll 1 and at the same time the roll 2 is moved toward the roll 1. Then, the angle bar 6 is fed into the gap defined between the rolls 1 and 3 and the gap defined between the rolls 1 and 2, so that roll bending will be performed thereon. At this time, one side of the angle bar 6 is fed into the gap defined between the rolls 1 and 3 and rolled in such a manner that its thickness decreases in going from its central portion toward its outer portion, and the other side thereof is fed into the gap between the rolls 1 and 2 and rolled to have a uniform thickness from edge to edge. The pressure applied to the roll 2 is sensed from an output of the load cell 31.

3. Operation of bending a Z bar

Figure 10:
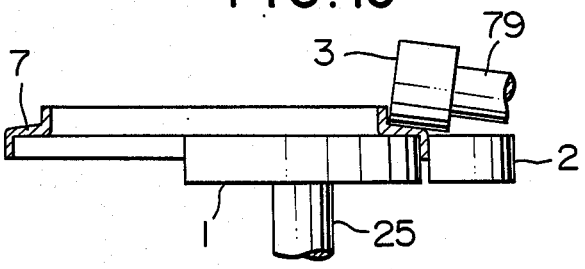
FIG. 10 is a view showing the arrangement of the rolling rolls for performing bending on a Z bar.

As shown in FIG. 10, the rolls 1–3 are arranged in the same manner as shown in FIG. 9, and a Z bar 7 is fed into the gap between the rolls 1 and 3 and the gap between the rolls 1 and 2.

4. Operation of bending a channel bar in such a manner that its center side is located on the inside (referred to as outward bending).

Figure 11:
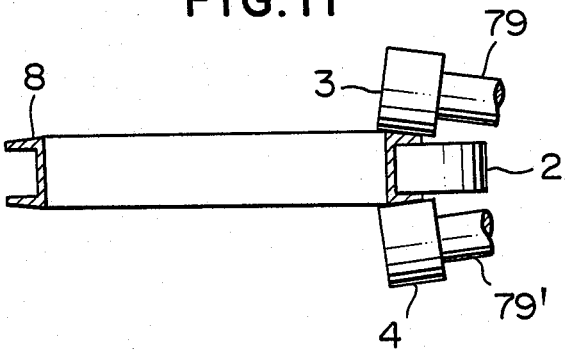
FIG. 11 is a view showing the arrangement of the rolling rolls for performing outward bending on a channel bar.

As shown in FIG. 11, a channel bar 8 has its opposite sides rolled by means of the rolls 1–3, to bend same.

5. Operation of bending a channel bar in such a manner that its center side is located on the outside (referred to as inward bending).

Figure 12:
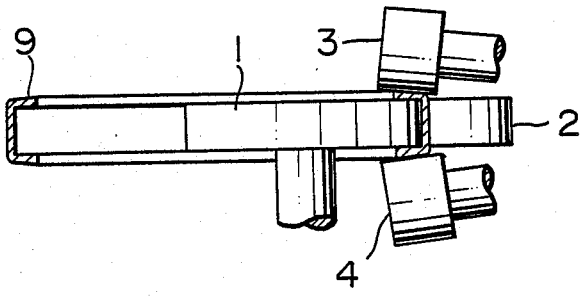
FIG. 12 is a view showing the arrangement of the rolling rolls for performing inward bending on a channel bar.

As shown in FIG. 12, roll bending is performed by means of the rolls 1–4.

In FIGS. 7–12, the radius of curvature of the shape metal may vary depending on the difference in rolling reduction between an inner side and an outer side of a shape metal subjected to roll bending.

Figure 13:
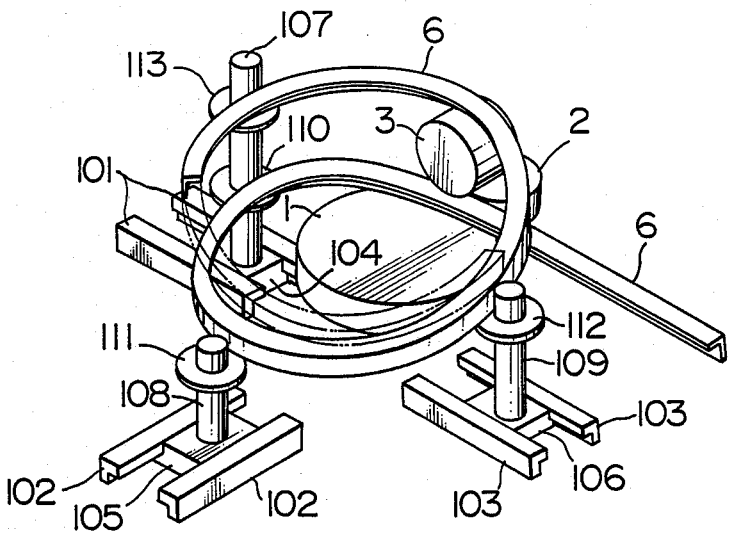
FIG. 13 is a perspective view of the guides for continuously performing outward bending on an angle bar, showing their arrangement.

FIG. 13 shows the essential portions of the roll bending apparatus for continuously bending the angle bar 6, which comprises guide means located on the table 18 for guiding the angle bar 6 after it has been subjected to roll bending.

More specifically, three pairs of guides 101, 102 and 103 arranged with a predetermined spacing interval between the associated guides have sliders 104, 105 and 106 fitted respectively between the associated guides for sliding movement. The sliders 104, 105, and 106 which may be fixed in position instead of moving in sliding movement have posts 107, 108 and 109 respectively which are disposed in upright positions thereon. Flanges 110, 111, 112 and 113 are rotatably supported on the posts 107, 108 and 109 for spirally guiding the angle bar 6 after it has been subjected to roll bending.

By arranging the guide means of the aforesaid construction on the table 18, it is possible to guide the angle bar 6 by the flanges 110, 111, 112 and 113 after it has been subjected to roll bending by means of the rolls 1–3 and to pile convolutions of the bent angle bar 6 in a stack.

Thus, the angle bar 6 which is elongated in length can be continuously bent.

Figure 14B:
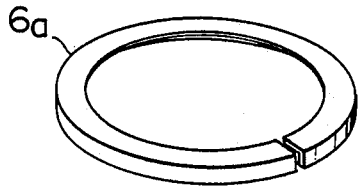
FIG. 14*b* is a perspective view of an angle bar corresponding to one annular article.
Figure 14A:
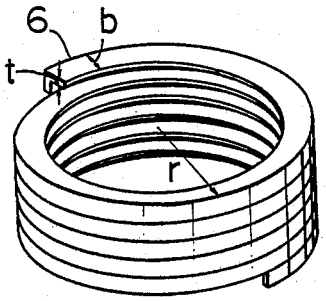
FIG. 14*a* is a perspective view of an angle bar subjected to continuous bending.
Figure 14C:
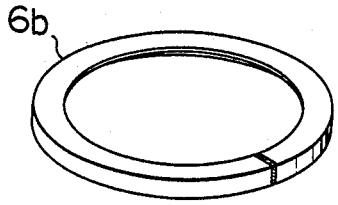
FIG. 14*c* is a perspective view of an annular article.

FIGS. 14*a*, 14*b* and 14*c* show the manner in which the angle bar 6 bent into spiral convolutions as described hereinabove is cut to produce rings each having a flange.

A portion 6*a* of the angle bar shown in FIG. 14*b* is severed from the angle bar 6 bent into spiral convolutions as shown in FIG. 14*a*. A ring 6*b* shown in FIG. 14*c* is provided by joining ends of the portion 6*a* together by welding or brazing.

Figure 15:
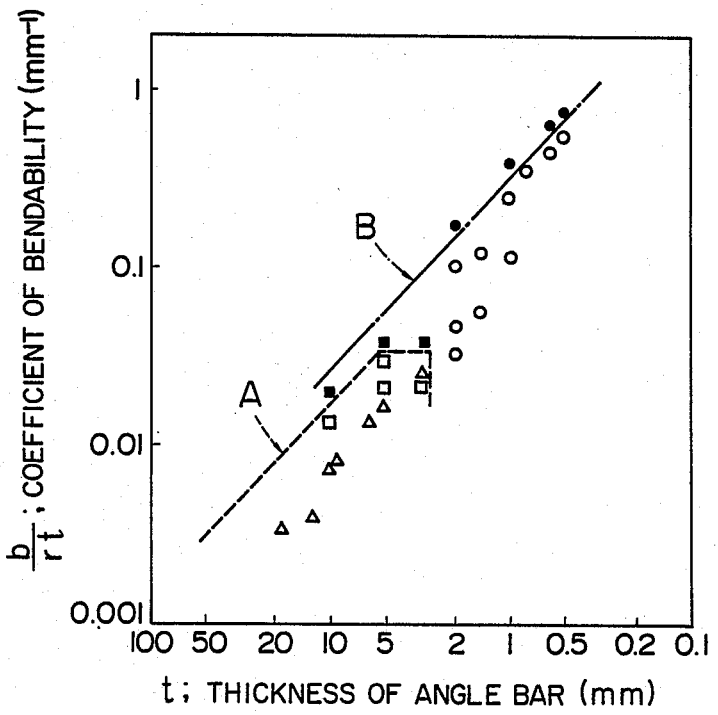
FIG. 15 is a characteristic diagram showing working limits.

FIG. 15 is a characteristic diagram showing the working limits of the angle bender of the prior art and the roll bending apparatus according to the invention. In the diagram, a phantom line A represents the working limits of the angle bender, and a solid line B indicates the working limits of the roll bending apparatus while t, b and r denote the thickness of the angle bar, the width of one side of the angle bar and the radius of curvature (see FIG. 14*a*) respectively. The symbols o, □ and Δ refer to articles of high quality and the symbols ●, ■ and ▲ refer to articles of poor quality (formation of riffles).

What is claimed is:

1. An apparatus for bending shape metals by rolling comprising:

a first rolling roll supported on an end of a rotational shaft thereof;

a second rolling roll having an outer circumferential surface located parallel to and in juxtaposed relation to an outer circumferential surface of said first rolling roll, said second rolling roll being movable toward and away from said first rolling roll;

a third rolling roll supported on an end of a rotational shaft thereof and having an outer circumferential surface opposed to at least one of first end faces of said first and second rolling rolls and said third rolling roll being tiltable with respect to said first end faces of the first and second rolling rolls, first means being provided for independently, adjustably, rotatably driving said third rolling roll and pressing said third rolling roll against a shape metal for bending said shape metal; and a fourth rolling roll supported on an end of a rotational shaft thereof and having an outer circumferential surface opposed to at least one of second end faces and tiltable with respect to said second end faces of the first and second rolling rolls, second means being provided for independently, adjustably, rotatably driving said fourth rolling roll and pressing said fourth rolling roll against a shape metal for bending said shape metal;

wherein said four rolling rolls are arranged in such a manner that axes thereof are located in one plane.

* * * * *